US006101658A

United States Patent [19]

Shehow et al.

[11] Patent Number: 6,101,658

[45] Date of Patent: Aug. 15, 2000

[54] LIQUID COATING APPLICATOR HAVING SPACED APPLICATING MEDIUMS

[75] Inventors: Kenneth L. Shehow, Milwaukee; Brian E. Woodnorth, Whitefish Bay, both of Wis.

[73] Assignee: Newell Operating Company, Freeport, Ill.

[21] Appl. No.: 09/134,797

[22] Filed: Aug. 14, 1998

Related U.S. Application Data

[63] Continuation-in-part of application No. 08/966,825, Nov. 10, 1997, Pat. No. 5,966,772.

[51] Int. Cl.[7] ..... B05C 17/00

[52] U.S. Cl. ..... 15/166; 15/176.1; 15/210.1; 15/244.1; 15/244.2; 15/257.05

[58] Field of Search ..... 15/104.94, 106, 15/114, 118, 160, 166, 176.1, 176.6, 209.1, 210.1, 210.5, 244.1–244.4, 257.05, 257.06

[56] References Cited

U.S. PATENT DOCUMENTS

| | | | |
|---|---|---|---|
| D. 269,650 | 7/1983 | Allison | D4/122 |
| D. 293,860 | 1/1988 | Smith | D4/122 |
| D. 305,080 | 12/1989 | Morgan et al. | D4/122 |
| D. 323,246 | 1/1992 | Best et al. | D4/122 |
| 329,601 | 11/1885 | Smith | 492/32 |
| D. 376,911 | 12/1996 | Zigelboim et al. | D4/122 |
| D. 395,169 | 6/1998 | Yang | D4/137 |
| 1,689,855 | 10/1928 | Breitenbach | 15/166 |
| 2,520,863 | 8/1950 | Thomas et al. | 15/27 |
| 2,669,743 | 2/1954 | Coughlan | 15/230.11 |
| 2,675,605 | 4/1954 | Thomas | 492/19 |
| 2,970,366 | 2/1961 | Gill | 492/19 |
| 2,982,010 | 5/1961 | Johns | 492/19 |
| 3,059,261 | 10/1962 | Carruth et al. | 15/210.5 |
| 3,205,526 | 9/1965 | Archibald | 15/230.11 |
| 3,346,900 | 10/1967 | Stewart et al. | 15/106 X |
| 3,447,184 | 6/1969 | McGinley | 15/230.11 |
| 3,562,837 | 2/1971 | Baginski et al. | 15/230.11 |
| 3,649,986 | 3/1972 | Dahlund | 15/230.11 |

(List continued on next page.)

FOREIGN PATENT DOCUMENTS

| | | | |
|---|---|---|---|
| 1107072 | 9/1953 | France . | |
| 585946 | 10/1933 | Germany | 15/166 |
| 851 946 | 10/1952 | Germany . | |
| 880395 | 6/1953 | Germany | 15/244.1 |
| 922 693 | 1/1955 | Germany . | |

*Primary Examiner*—Mark Spisich
*Attorney, Agent, or Firm*—Foley & Lardner

[57] ABSTRACT

A liquid coating applicator for use with a plurality of adjacent basins separated by a partition includes a support having a handle portion, a first liquid applying medium coupled to the support and having a first applicating surface extending in a plane and a second liquid applying medium coupled to the support and having a second applicating surface extending in the plane. The first and second liquid applying mediums are spaced from one another so as to form a slot therebetween. The slot is configured to receive the partition such that the first and second applicating surfaces of the first and second mediums may be simultaneously received within the first and second basins to load the first and second mediums with different liquid coatings.

24 Claims, 3 Drawing Sheets

U.S. PATENT DOCUMENTS

| | | | |
|---|---|---|---|
| 3,728,755 | 4/1973 | Whalen | 15/210.1 |
| 3,745,624 | 7/1973 | Newman | 492/19 |
| 3,751,748 | 8/1973 | Roe et al. | 15/230.11 |
| 3,877,123 | 4/1975 | Pharris | 492/19 |
| 3,942,209 | 3/1976 | Walls | 15/118 |
| 4,171,574 | 10/1979 | Gratzl et al. | 15/244.1 X |
| 4,209,883 | 7/1980 | Hawk | 492/19 |
| 4,244,074 | 1/1981 | Barcikowski et al. | 15/114 |
| 4,316,301 | 2/1982 | Smith et al. | 15/230.11 |
| 4,361,923 | 12/1982 | McKay | 15/104.002 |
| 4,402,102 | 9/1983 | Al-Samman | 15/230.11 |
| 4,483,036 | 11/1984 | Sayklay | 15/210.5 X |
| 4,528,712 | 7/1985 | Leibow | 15/118 |
| 4,829,623 | 5/1989 | Brezette et al. | 15/246 |
| 4,897,893 | 2/1990 | Barker | 15/230.11 |
| 4,937,909 | 7/1990 | Georgion | 15/230.11 |
| 4,985,958 | 1/1991 | Garcia | 15/114 |
| 4,996,735 | 3/1991 | Blankenship | 15/210.1 |
| 5,345,648 | 9/1994 | Graves | 15/230.11 |
| 5,412,829 | 5/1995 | Hefner | 15/244.1 X |
| 5,490,303 | 2/1996 | Graves | 15/230.11 |
| 5,594,971 | 1/1997 | Nelson | 15/230.11 |
| 5,713,095 | 2/1998 | Wakat | 15/230.11 |

116
122
114
126
123
120
123
124
146
118
132
128
134
4
148
142
4
124
144

132
149
134
144
150

150
144
156
134
154
150
142
134
132
5
5
149
158
162
164
160

118
124
132
124
134
150

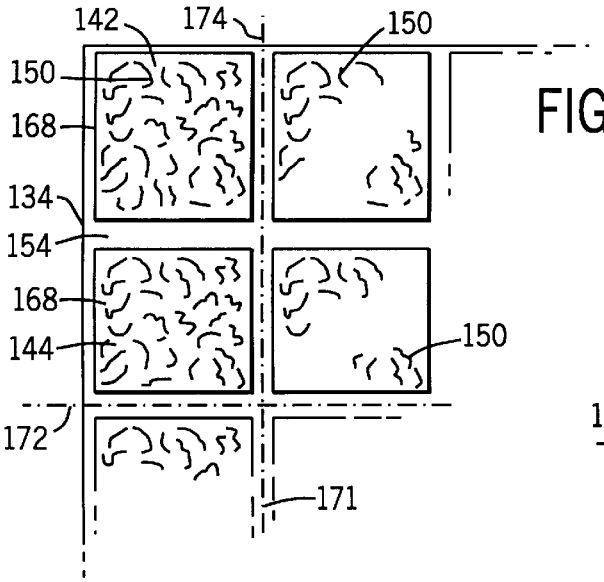
FIG. 7
FIG. 8
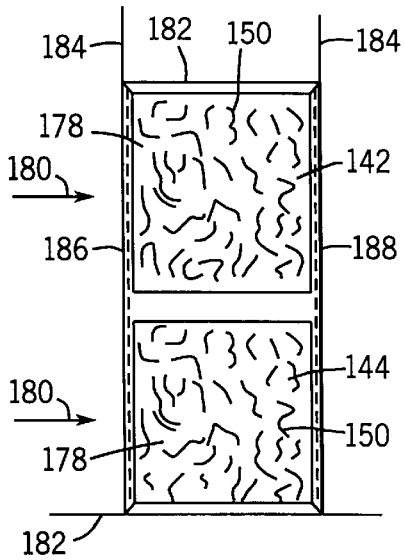
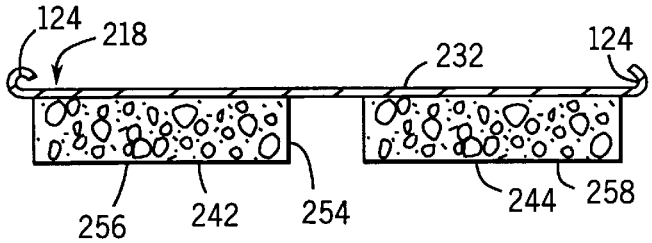
FIG. 9
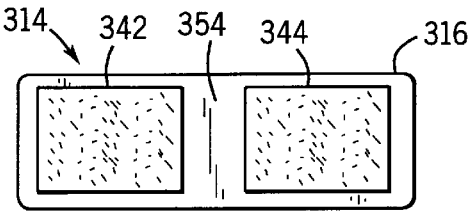
FIG. 11
FIG. 10
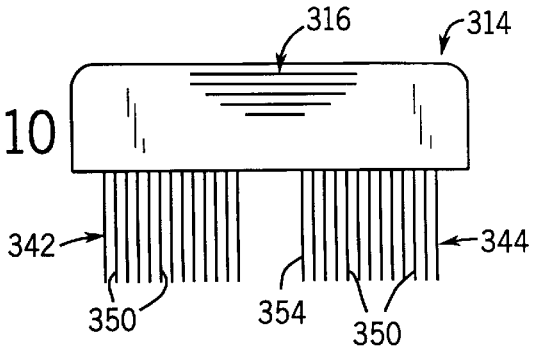

LIQUID COATING APPLICATOR HAVING SPACED APPLICATING MEDIUMS

CROSS REFERENCE TO RELATED APPLICATION

The present application is a continuation-in-part of U.S. patent application Ser. No. 08/966,825, filed Nov. 10, 1997 entitled PAINT SUPPLY AND FINISHING SYSTEM which issued on Oct. 19, 1999 as U.S. Pat. No. 5,966,772, from which priority is claimed under 35 U.S.C. § 120.

FIELD OF THE INVENTION

The present invention relates to liquid coating applicator systems for applying a liquid coating such as paint to a surface such as a wall. In particular, the present invention relates to a liquid coating applicator system which includes a liquid coating applicator having a plurality of spaced paint applying mediums for simultaneously applying different colors of liquid coatings to a surface to produce a decorative effect on the surface.

BACKGROUND OF THE INVENTION

Liquid coating applicators, such as rollers, brushes and pads, are commonly used to apply liquid coatings, such as paints, stains and varnishes to surfaces such as walls and floors. In recent years, such conventional rollers, brushes and pads have been increasingly used to create decorative or faux finishes on surfaces such as walls. In addition, several other tools or liquid applying mediums have been used to create various decorative patterns or textures on surfaces. These tools or liquid applying mediums includes stippling brushes, open-celled sponges, rags and various textured naps of material. In addition, rollers have been modified to include patterns.

To create decorative finishes, the patterned rollers are generally rolled across the surface to create a repeating pattern. In contrast, liquid coating applicators which include liquid applying mediums that extend within a single plane, such as stippling brushes, open-celled sponges and rags are generally dabbed or patted against the surface.

In many cases, depending upon the desired effect, it is desirable to apply several colors, shades or even types of liquid coatings or paints to the surface. To apply multiple colors to a surface typically requires that a separate liquid coating applicator be used for each color or that a single liquid coating applicator be cleaned prior to being loaded with a different color. Repeated loading of both liquid coating applicators or repeated loading and cleaning of a single liquid coating applicator to apply multiple colors to a surface is tedious and time consuming. In addition, unless extreme caution is practiced, using multiple paint applicators or alternating a single paint applicator between different colors results in mixed paint supplies. Moreover, it is extremely difficult to blend or overlap multiple colors by alternately applying different colors with different paint applicators or with a single paint applicator since the liquid coating may partially dry between the application of different colors.

To enable the creation of different colored continuous patterns along a wall, paint rollers including a single rod or a pair of rods supporting two separate rollers have been developed. Despite these advancements in the art, there remains a continuing need for a liquid coating applicator system and a liquid coating applicator which enables the simultaneous application of different liquid coatings by applicating surfaces that extend in a single plane and that are patted against the surface being decorated.

SUMMARY OF THE INVENTION

A liquid coating applicator for use with a plurality of adjacent basins separated by a partition includes a support having a handle portion, a first liquid applying mediums coupled to the support and having a first applicating surface extending in a plane and a second liquid applying mediums coupled to the support and having a second applicating surface extending in the plane. The first and second liquid applying mediums are spaced from one another so as to form a slot therebetween. The slot is configured to receive the partition such that the first and second applicating surfaces of the first and second mediums may be simultaneously received within the first and second basins to load the first and second mediums with different liquid coatings.

According to one aspect of the present invention, the first and second liquid applying mediums are attached to the support such that the slot between the first and second liquid applying mediums has a preselected, fixed uniform width for consistently receiving the partition. According to yet another aspect of the present invention, the support includes a pair of spaced flanges. The base includes a pair of spaced channels slidably receiving the pair of spaced flanges to removably couple the base to the support.

According to yet another aspect of the present invention, the first and second mediums include a first set of bristles and a second set of bristles, respectively, wherein the first and second set of bristles are configured to stipple a surface with a liquid coating.

According to yet another aspect, the first and second liquid applying mediums comprise sponges.

According to yet another aspect of the present invention, the liquid coating applicator includes a substrate coupled to the support and at least one material strand threaded through the substrate. The at least one material strand is preferably threaded through the substrate so as to form a plurality of loops extending from the substrate. Preferably, at least one first material strand is threaded through the substrate along a first area of the substrate to form the first applying medium while at least one second material strand is threaded through the substrate along a second area spaced from the first area to form the second applying medium. Preferably, the substrate extends outwardly beyond the first and second mediums.

The present invention is also directed to the liquid coating applicator system including a tray and a liquid coating applicator. The tray has a first basin and a second basin separated by a partition. The liquid coating applicator includes a support having a handle portion, a first liquid applying mediums coupled to the support of having a first applicating surface extending in a plane, and a second liquid applying mediums coupled to the support and having a second applicating surface extending in the plane. The first and second liquid applying mediums are spaced from one another so as to form a slot there between. The slot is configured to receive the partition such that the first and second applicating surfaces of the first and second mediums may be simultaneously received within the first and second basins.

BRIEF DESCRIPTION OF THE DRAWINGS

FIG. 7 is a top elevational view of a substrate sheet supporting a plurality of liquid applying mediums prior to being cut and assembled as part of a pad assembly.

FIG. 8 is a top elevational view of a substrate supporting a plurality of liquid applying mediums after being cut and serged prior to being assembled as part of a pad assembly.

FIG. 9 is a sectional view of an alternate embodiment of the pad applicator.

FIG. 10 is a side elevational view of an alternate embodiment of the liquid coating applicator of FIG. 3.

FIG. 11 is a bottom elevational view of the liquid coating applicator of FIG. 10.

DESCRIPTION OF THE PREFERRED EMBODIMENTS

Figure 1:
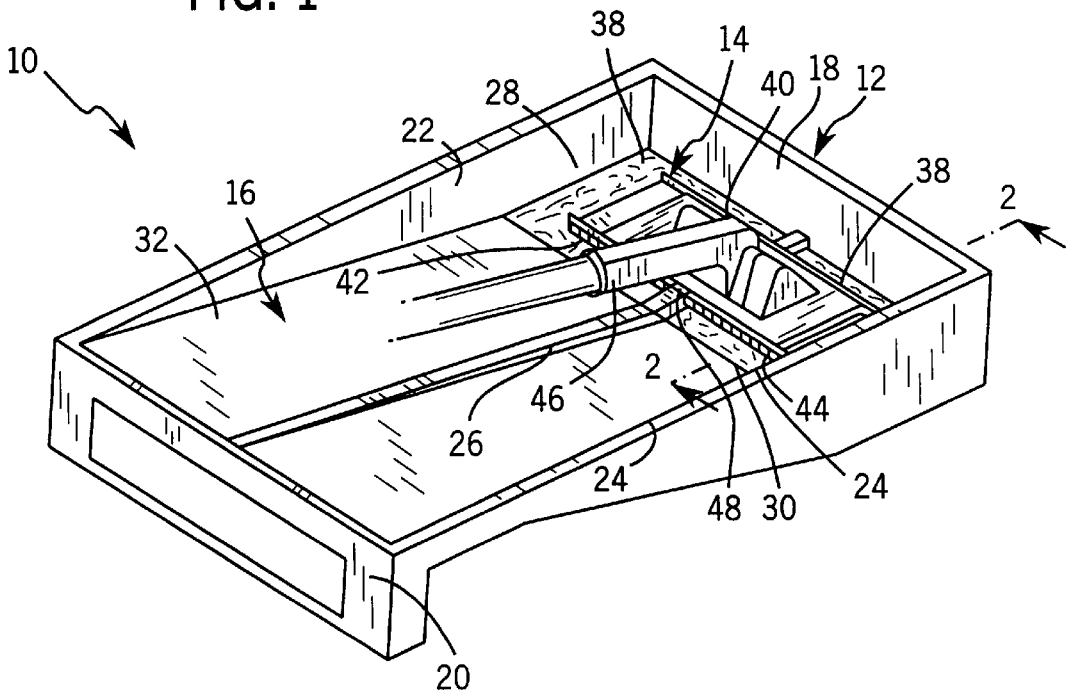
FIG. 1 is a perspective view of a liquid coating applicator system of the present invention, including a tray and a liquid coating applicator.
Figure 2:
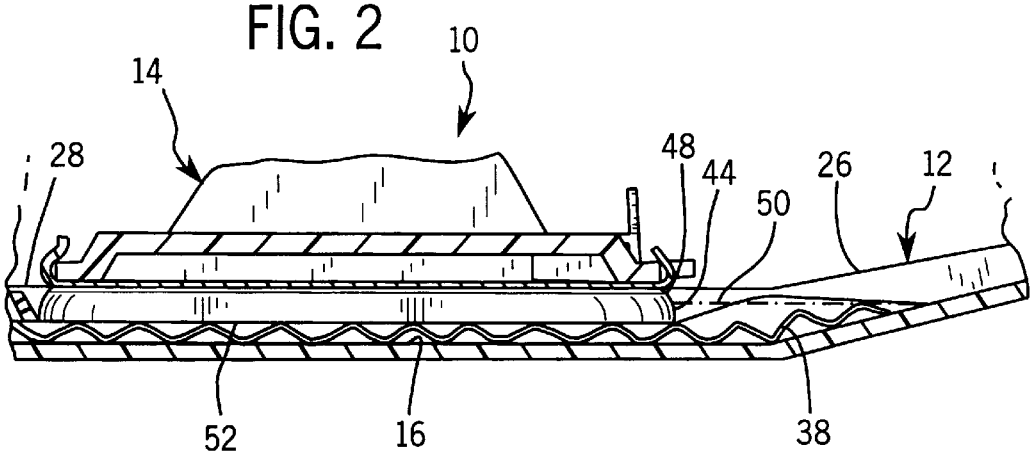
FIG. 2 is a fragmentary sectional view of the liquid coating applicator of FIG. 1 received within the tray of FIG. 1.

FIGS. 1 and 2 illustrate liquid coating applicator system 10 which generally includes tray 12 and liquid coating applicator 14. Tray 12 generally includes floor 16, front wall 18, rear wall 20, side walls 22, 24, and partitioning wall 26. Walls 18, 20, 22, 24, and 26 extend upwardly from floor 16 to form basins or pans 28 and 30. Pans 28 and 30 are generally elongate channels configured for simultaneously receiving portions of liquid coating applicator 14. Pans 28, 30 also provide reservoirs for containing different colors of liquid coating such as paint. Partitioning wall 26 preferably has a reduced height facility for positioning of perforated portions of liquid coating applicator 14 into pans 28 and 30. As further shown by FIG. 1, floor 16 is configured to form ramps 32 to assist in removing excess paint from liquid coating applicator 14. In the preferred embodiment, pans 28, 30 include paint metering mediums 38.

Paint metering mediums 38 meter an amount of paint to liquid coating applicator 14. In particular, mediums 38 make available an amount of paint to liquid coating applicator depending upon the pressure applied to mediums 38 by liquid coating applicator 14. Mediums 38 preferably comprise resiliently compressible grids which rest upon floor 16 and which extend through the paint or other liquid coating so as to form a supporting surface above the surface of the paint or liquid coating within pans 28 and 30. Metering mediums 38 prevent liquid coating applicator 14 from absorbing an excessive amount of paint. This is extremely important when performing a faux finishing technique. Paint metering mediums 38 are preferably removably positioned within pans 28 and 30 so as to enable mediums 38 to be removed for cleaning, replacement, or for performing other full finishing techniques. Although paint metering mediums 38 preferably comprise an open resiliently compressible plastic grid, the paint metering mediums 38 may alternatively comprise paint absorbing foam or other materials or structures which may meter paint to liquid coating applicator 14 such as coating grids, rolled wire mesh, and the like. Other structures may also be used which utilize wicking or capillary action to meter the amount of paint made available to liquid coating applicator 14. Although tray 12 is illustrated as a single tray, tray 12 may have various structures and may include multiple components or inserts which are attached together to form the tray assembly having a plurality of pans or basins separated by a partition. For example, tray 12 may alternatively comprise the trays illustrated and described in co-pending application Ser. No. 08/966,825, filed on Nov. 10, 1997, and entitled "Faux and Decorative Finishing System", U.S. Pat. No. 5,966,772, the full disclosure of which is hereby incorporated by reference.

Liquid coating applicator 14 generally includes support 40, liquid applying mediums 42 and liquid applying mediums 44. Support 40 includes a handle portion 46 which is adapted for being grasped by the user's hand and which is adapted for being mounted to an extension pole or other extension device. Support 40 supports liquid applying mediums 42 and 44.

Liquid applying mediums 42 and 44 are coupled to support 40 and are carried by support 40 during the application of liquid coating to a surface such as a wall. Liquid applying mediums 42 and 44 carry the liquid coating and release the liquid coating onto the wall or surface when placed in contact with the wall or surface. Liquid applying mediums 42 and 44 are transversely spaced from one another so as to form a slot 48 between. Slot 48 is specifically configured to receive partitioning wall 26 such that liquid applying mediums 42 and 44 may be simultaneously received within pans 28 and 30 for being loaded with different colors of liquid coatings.

FIG. 2 is a sectional view of system 10 taken along lines 2—2 of FIG. 1. As is shown by FIG. 2, as liquid coating applicator 14 is lowered into tray 12, slot 48 receives partitioning wall 26 such that liquid applying mediums 42 (shown in FIG. 1) and liquid applying mediums 44 extend into pans 28 and 30, respectively, to compress metering medium 38 below the surface of paint or other liquid coating 50 to load liquid applying mediums 42 and 44 with the liquid coating. At the same time, partitioning wall 26 engages liquid coating applicator 14 within slot 48 to limit and control the extent to which liquid applying mediums 42 and 44 and their liquid applicating surfaces 52 are lowered into pans 28 and 30 of tray 12. Consequently, this interaction between liquid coating applicator 14 and partitioning wall 26 further controls the amount of liquid coating loaded onto liquid applying mediums 42 and 44 to enable liquid coating applicator 14 to produce a better decorative finish.

Figure 3:
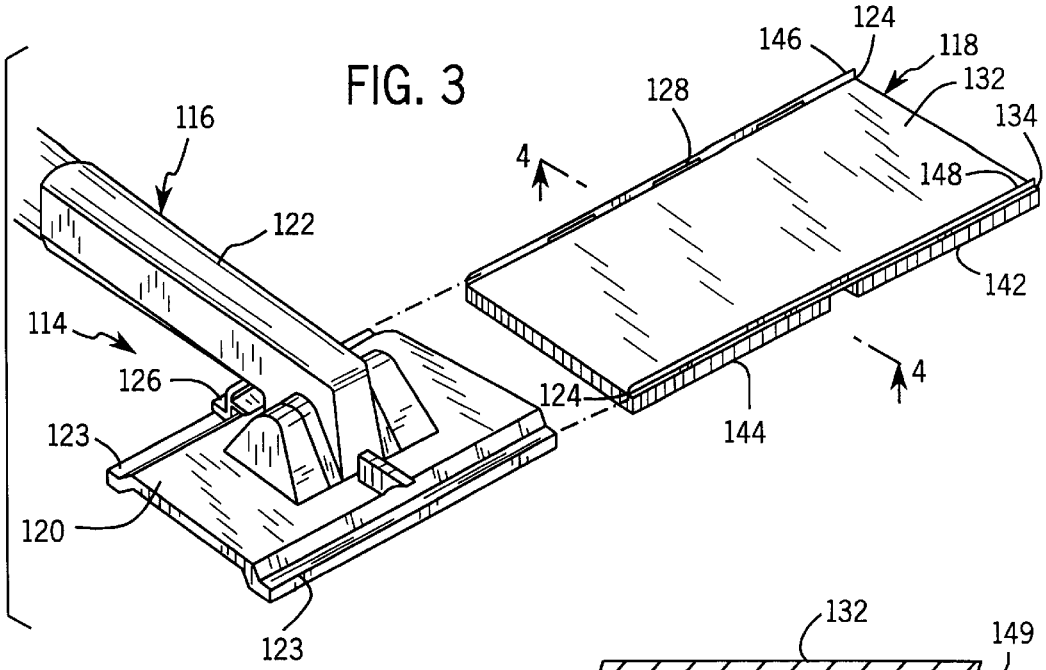
FIG. 3 is an exploded perspective view of the liquid coating applicator of FIG. 1, including a support and a pad assembly.

FIG. 3 illustrates liquid coating applicator 114, an alternate embodiment of liquid coating applicator 14 shown in FIGS. 1 and 2. Liquid coating applicator 114 includes support 116 and applicator pad assembly 118. Support 116 generally includes an attachment portion 120 and a handle portion 122. Attachment portion 120 is pivotally coupled to handle portion 122 and is configured for being removably coupled to pad assembly 118. In the exemplary embodiment, attachment portion 120 includes tabs or flanges 123 adapted for being slidably received within corresponding channels 124 of pad assembly 118. Attachment portion 120 additionally includes a resiliently biased latch 126 which is configured to extend through a corresponding slot 128 in pad assembly 118. As a result, attachment portion 120 and support 116 securely supports and retains pad assembly 118 in place as liquid coating applicator 114 is dabbed against or moved along the surface being coated. Various other mechanisms and structures may be used for releasibly coupling attachment portion 120 to pad assembly 118. Although less desirable, attachment portion 120 may alternatively be configured for being permanently attached to pad assembly 118.

Handle portion 122 extends from attachment portion 120 and is configured for being grasped by the user's hands during use. Handle portion 122 is further configured for removably receiving an elongate pole or extension for enabling liquid coating to be applied to otherwise unreachable surfaces.

Pad assembly 118 releasibly attaches to attachment portion 120 of support 116 and generally includes base 132, substrate 134, and liquid applying mediums 142, 144. Base 132 comprises an elongate rigid panel with upwardly and inwardly turned edges 146, 148 which form channels 124. Channels 124 are sized for receiving flanges 123 of attachment portion 120. Edge 146 additionally includes slots 128 for receiving latch 126 of attachment portion 120. Slot 128 receives latch 126 to releasibly latch or lock base 132 and pad assembly 118 to attachment portion 120. In the exemplary embodiment illustrated, base 132 comprises a thin sheet of metal such as aluminum. Moreover, base 132 should preferably form from a solvent resistent material. Base 132 supports substrate 134 and liquid applying mediums 142 and 144.

Figure 5:
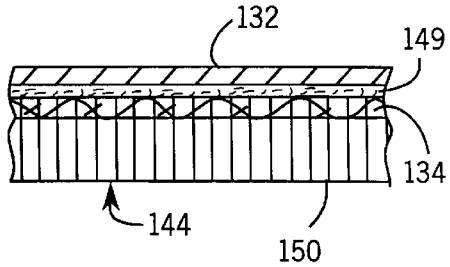
FIG. 5 is a sectional view of the pad assembly of FIG. 4 taken along lines 5—5.
Figure 4:
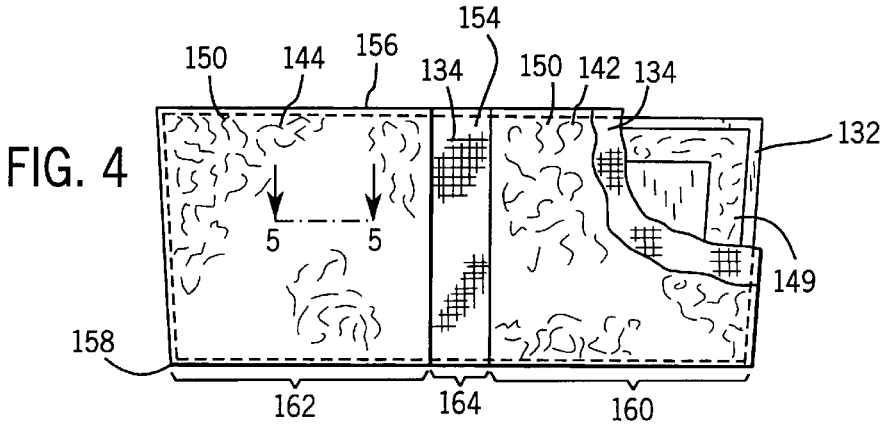
FIG. 4 is a bottom elevational view of the pad assembly of FIG. 3 taken along lines 4—4.
Figure 6:
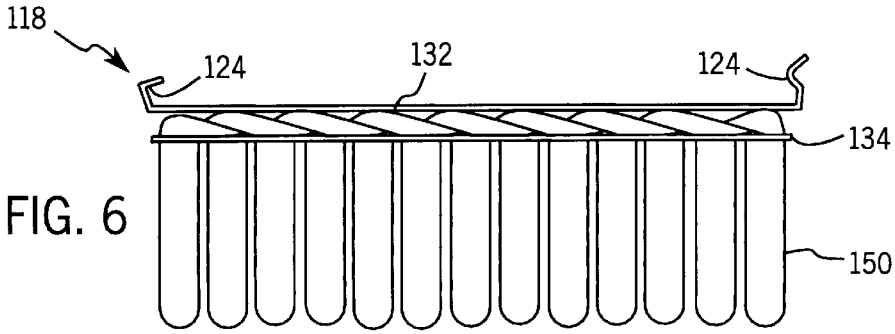
FIG. 6 is an end elevational view of the pad assembly of FIG. 3.

FIGS. 4–7 illustrate substrate 134 and liquid applying mediums of pad assembly in greater detail. FIG. 4 is a bottom elevational view of pad assembly 118 along lines 4—4 of FIG. 3 with portions removed for purposes of illustration. FIG. 5 is a sectional view of assembly 118 taken along lines 5—5 of FIG. 4. FIG. 6 is an end elevational view of pad assembly 118. Substrate 134 comprises an elongate continuous backing supporting both liquid applying mediums 142 and 144. Substrate 134 is preferably configured such that strands of material may be threaded or sewn through substrate 134. Substrate 134 preferably comprises a non-woven composite such as TYPAR. Alternatively, substrate 134 may comprise other woven or non-woven sheets through which strands may be threaded. Substrate 134 is preferably reusable and preferably has sufficient strength so as to not tear in normal painting applications.

As shown by FIGS. 4 and 5, substrate 134 is preferably affixed to base 132 by an adhesive layer 149 which is resistent to most solvents used in applications that involve paint, stains, and varnishes. Substrate 134 is preferably bonded to base 132 by an epoxy. Alternatively, base 132 may be formed by a thermoplastic while substrate 134 is also formed from a thermoplastic material wherein base 132 and substrate 134 are both heated to fuse base 132 and substrate 134 together.

As is shown by FIG. 6, liquid applying mediums 142 and 144 comprise at least one material strand 150 which is threaded or sewn across and through substrate 134. In an exemplary embodiment, liquid applying mediums 142 and 144 are formed from a single continuous strand of material which is threaded through substrate 134 to form a plurality of loops extending approximately 1.0 inches above substrate 134. The material forming the strand 150 preferably comprises a multiple ply twisted yarn of rayon fiber. Alternatively, other natural or synthetic fabrics yarns that do not unravel or shed and that hold up to water and oil based paints, cleaning solvents, soap and glazes may be used. The filament or strand 150 preferably has a diameter of approximately 0.25 inches.

As best shown by FIG. 4, paint applying mediums 142 and 144 are separated from one another by slot 154. Slot 154 is sufficiently sized for receiving partitioning wall 26 of tray 12 (shown in FIG. 1) such that liquid applying mediums 142 and 144 are simultaneously received within pans 28 and 30 to compress metering medium 38 and to absorb different colors of liquid coatings contained on the sides of partitioning wall 26. In the exemplary embodiment illustrated, slots 154 are the width of approximately 0.5 inches. Base 132 and substrate 134 each have the width of approximately 3.5 inches and the length of approximately 8.25 inches. Liquid applying mediums 142 and 144 each have the width of about 3.25 inches and a length of about 3.75 inches. Base 132 and substrate 134 extend approximately 0.125 inches beyond each outer edge of liquid applying mediums 142 and 144. Each liquid applying medium 142 and 144 includes approximately 15 equidistantly spaced rows of stitched strands 150 extending parallel to one another between front edge 156 and rear edge 158.

To form slot 154, strand 150 is first sewn to substrate 134 in rows across the first portion 160 of substrate 134. A second plurality of rows of strands 150 is then sewed along a second area or portion 162 of substrate 134. The remaining intermediate area or portion 164 of substrate 134 remains free of liquid applying mediums 142 or 144 to define slot 154. Because slot 154 is formed by simply not threading or stitching strand or strands 150 to intermediate portion 164 of substrate 134, strands 150 do not need to be severed or sheared from substrate 134 to form slot 154. As a result, strands 150 do not unravel or unthread along the edge of slot 154. Furthermore, the edges of liquid applying mediums 142 and 144 do not need to be serge or sewn to prevent unraveling. As a result, manufacture of substrate 134 and liquid applying mediums 142 and 144 is simpler and less expensive. In addition, substrate 134 and liquid applying mediums 142 and 144 may be formed with less material waste. Yet another advantage associated with the method of forming substrate 134 and liquid applying mediums 142 and 144 is that fewer pieces or parts are involved which enables simpler handling and simpler assembly of pad assembly 118. Instead of having two separate pieces or pieces of substrate which support liquid applying mediums 142 and 144 then which must be separately mounted to base 132, liquid applying mediums 142 and 144 are supported by a single continuous substrate 134 which can be more easily handled and more easily assembled to base 132. In addition, the width of slot 154 may be more precisely controlled.

FIGS. 7 and 8 illustrate alternative methods for forming spaced liquid applying mediums 142 and 144 upon substrate 134. According to the method shown on FIG. 7, substrate 134 is provided as a single sheet upon which material strands 150 are sewn to provide liquid applying mediums 142 and 144 for a plurality of pad assemblies 118. As best shown by FIG. 7, strands 150 are sewn through substrate 134 at a plurality of spaced, generally rectangular sections 168. Adjacent pairs of liquid applying mediums 142 and 144 are then severed from the remaining sheet of substrate 134 along cut lines 170 and 172. Because cut lines 170 and 172 extend between sections 168, cut lines 170 and 172 do not sever material strands 150. As a result, material strands 150 do not unravel. Moreover, the edges of substrate 134 supporting liquid applying mediums 142 and 144 do not need to be serged to prevent unraveling.

FIG. 8 illustrates an alternative method of forming liquid applying mediums 142 and 144 upon substrate 134. According to the method illustrated in FIG. 8, strands 150 are sewn in continuous parallel rows in the directions indicated by arrows 180 along substrate 134. Substrate 134 is then cut along cut lines 182 between the rows while substrate 134 is further cut along cut lines 184 across the rows to form an individual substrate 134 supporting two spaced liquid applying mediums 142 and 144. Because cut lines 184 extend through material strands 150, opposing edges 186 and 188 along cut lines 184 must be serged or sewn to prevent unraveling of material strands 150.

FIG. 9 is a sectional view of pad assembly 218, an alternate embodiment of pad assembly 118. Similar to pad assembly 118, pad assembly 218 is configured for use with support 116. Pad assembly 218 generally includes base 232 and liquid applying mediums 242 and 244. Base 232 is identical to base 132 except that base 232 supports liquid applying mediums 242 and 244.

Liquid applying mediums 242 and 244 comprise individual pieces of open celled sponge, which are affixed, preferably by adhesive, to base 232. Liquid applying mediums 242 and 244 are preferably affixed to base 232 by a solvent resistent adhesive, such as epoxy. Liquid applying mediums 242 and 244 are affixed to base 232 at spaced locations so as to form slot 254. Slot 254 is configured for receiving partitioning wall 26 of tray 12 (shown in FIG. 1). As a result, liquid applying mediums 242 and 244 may be simultaneously lowered into and received by pans 28 and 30 containing different colors of liquid coatings. As will be appreciated, the exact configuration of slot 254 will vary depending upon the dimensions of the partitioning wall utilized in tray 12.

FIGS. 10 and 11 illustrate liquid coating applicator 314, an alternate embodiment of liquid coating applicator 114. Liquid coating applicator 314 includes support 316 and liquid applying mediums 342 and 344. Support 316 is affixed to liquid applying mediums 342 and 344 and is configured for being grasped by a user's hand for manipulation of applicator 314. Alternatively, support 316 may be configured for releasibly receiving an extension pole or other extension device.

Liquid applying mediums 342 and 344 each comprise a cluster a upstanding elongate bristles 350. Bristles 350 carry liquid coating such as paint between the ends. Bristles 350 have a sufficient rigidity for being dabbed or stippled against a surface to produce a decorative effect.

Liquid applying mediums 342 and 344 are spaced from one another by an intervening channel or slot 354. Slot 354 is configured to receive partitioning wall 26 of tray 12 (shown in FIG. 1). As a result, each cluster of bristles providing liquid applying mediums 342 and 344 may be simultaneously lowered into adjacent but separated pans 28 and 30 to load mediums 342 and 344 with different colors of paints. These different colored liquids or paints will then be dabbed against a surface and overlapped to create a desired stippled decorative effect on the surface.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A liquid coating applicator for use with first and second adjacent basins separated by a partition, the applicator comprising:

a support having a handle portion;

a first liquid applying medium coupled to the support, the first medium having an applicating surface extending in a plane;

a second liquid applying medium coupled to the support, the second medium having an applicating surface extending in the plane, wherein the first and second liquid applying mediums are spaced from one another so as to form a slot therebetween, the slot being configured to receive the partition such that the first and second applicating surfaces of the first and second mediums may be simultaneously received within the first and second basins; and a base removably coupled to the support, wherein the first and second liquid applying mediums are affixed to the base at spaced locations such that the slot therebetween has a fixed width.

2. The liquid coating applicator of claim 1, wherein the first and second liquid applying mediums are attached to the support such that the slot between the first and second liquid applying mediums has a preselected, fixed uniform width for consistently receiving the partition.

3. The liquid coating applicator of claim 1, wherein the support includes a pair of spaced flanges and wherein the base includes a pair of spaced channels slidably receiving the pair of spaced flanges to removably couple the base to the support.

4. The liquid coating applicator of claim 1, wherein the first and second mediums include a first set of bristles and a second set of bristles, respectively, wherein the first and second set of bristles are configured to stipple a surface with a liquid coating.

5. The liquid coating applicator of claim 1, wherein the first and second liquid applying mediums comprise sponges.

6. The liquid coating applicator of claim 1, including:

a substrate coupled to the support; and at least one material strand threaded through the substrate.

7. The liquid coating applicator of claim 6, wherein the at least one material strand is threaded through the substrate so as to form a plurality of loops extending from the substrate.

8. The liquid coating applicator of claim 1, including:

a substrate coupled to the support;

at least one first material strand threaded through the substrate along a first area of the substrate to form the first applying medium; and at least one second material strand threaded through the substrate along a second area spaced from the first area to form the second applying medium.

9. The liquid coating applicator of claim 8, wherein the substrate extends outwardly beyond the first and second mediums.

10. The liquid coating applicator of claim 8, wherein the at least one first and second material strands are threaded through the substrate at the first and second areas, respectively, so as to form a first plurality of loops along the first area and a second plurality of loops along the second area.

11. A liquid coating applicator system comprising:

a tray having a first basin and a second basin separated by a partition; and a liquid coating applicator including:

a planar support having a handle portion;

a first liquid applying medium coupled to a lower surface of the support, the first medium having an applicating surface extending in a plane; and a second liquid applying medium coupled to the lower surface of support, the second medium having an applicating surface extending in the plane, wherein the first and second liquid applying mediums are spaced from one another so as to form a slot therebetween, the slot being configured to receive the partition such that the first and second applicating surfaces of the first and second mediums may be simultaneously received within the first and second basins, wherein the partition has a height such that the partition is adapted to engage the lower surface of the support to control the extent to which the first and second liquid applying mediums are lowered into the first and second basins, respectively.

12. The system of claim 11 wherein the first basin and the second basin each include a well and a ramp extending from the well.

13. The system of claim 12 including a paint metering medium disposed within the well.

14. A removable liquid coating applicator pad assembly for a use with a system including a support having a handle portion and first and second adjacent basins separated by a partition, the pad assembly comprising:

a base adapted for being removably coupled to the support;

a first liquid applying medium coupled to the base, the first medium having an applicating surface extending in a plane; and a second liquid applying medium coupled to the base, the second medium having an applicating surface extending in the plane, wherein the first and second liquid applying mediums are spaced from one another so as to form a slot therebetween, the slot being configured to receive a partition such that the first and second applicating surfaces of the first and second mediums may be simultaneously received within the first and second basins.

15. The pad assembly of claim 14, wherein the first and second liquid applying mediums are attached to the base such that the slot between the first and second liquid applying mediums has a preselected, fixed uniform width for consistently receiving the partition.

16. The pad assembly of claim 14, wherein the support includes a pair of spaced tabs and wherein the base includes a pair of spaced channels slidably receiving the pair of spaced tabs to enable the base to be removably coupled to the support.

17. The pad assembly of claim 14, wherein the first and second liquid applying mediums comprise sponges.

18. The pad assembly of claim 14, including:

a substrate affixed to the base; and at least one material strand threaded through the substrate.

19. The pad assembly of claim 18, wherein the at least one material strand is threaded through the substrate so as to form a plurality of loops extending from the substrate.

20. The pad assembly of claim 14, including:

a substrate coupled to the base;

at least one first material strand threaded through the substrate along a first area of the substrate to form the first applying medium; and at least one second material strand threaded through the substrate along a second area spaced from the first area to form the second applying medium.

21. The pad assembly of claim 20, wherein the substrate extends outwardly beyond the first and second mediums.

22. The pad assembly of claim 21, wherein the at least one first and second material strands are threaded through the substrate at the first and second areas, respectively, so as to form a first plurality of loops along the first area and a second plurality of loops along the second area.

23. A liquid coating applicator for use with first and second adjacent basins separated by a partition, the applicator comprising:

a support having a handle portion;

a substrate coupled to the support;

a first liquid applying medium coupled to the support, the first medium having an applicating surface extending in a plane;

a second liquid applying medium coupled to the support, the second medium having an applicating surface extending in the plane, wherein the first and second liquid applying mediums are spaced from one another so as to form a slot therebetween, the slot being configured to receive the partition such that the first and second applicating surfaces of the first and second mediums may be simultaneously received within the first and second basins; and at least one material strand threaded through the substrate, wherein the at least one material strand is threaded through the substrate so as to form a plurality of loops extending from the substrate to form at least one of the first and second liquid applying mediums.

24. A liquid coating applicator for use with first and second adjacent basins separated by a partition, the applicator comprising:

a support having a handle portion;

a substrate coupled to the support;

a first liquid applying medium coupled to the support, the first medium having an applicating surface extending in a plane;

a second liquid applying medium coupled to the support, the second medium having an applicating surface extending in the plane, wherein the first and second liquid applying mediums are spaced from one another so as to form a slot therebetween, the slot being configured to receive the partition such that the first and second applicating surfaces of the first and second mediums may be simultaneously received within the first and second basins;

at least one first material strand threaded through the substrate along a first area of the substrate to form the first applying medium; and at least one second material strand threaded through the substrate along a second area spaced from the first area to form the second applying medium.

* * * * *